US005713227A

United States Patent [19]

Turnbo

[11] Patent Number: 5,713,227

[45] Date of Patent: Feb. 3, 1998

[54] LEVER ACTIVATED DEAD-BOLT LOCK

[76] Inventor: William A. Turnbo, 6577 Millsfield Hwy., Newbern, Tenn. 38059

[21] Appl. No.: 643,478

[22] Filed: May 6, 1996

[51] Int. Cl.[6] ..... E05B 55/00

[52] U.S. Cl. ..... 70/144; 70/478; 292/175

[58] Field of Search ..... 70/143, 144, 145, 70/372, 478, 447, 449; 292/175, 173, 57

[56] References Cited

U.S. PATENT DOCUMENTS

| | | | |
|---|---|---|---|
| 2,865,666 | 12/1958 | Kubik . | |
| 2,878,049 | 3/1959 | Linton . | |
| 3,222,097 | 12/1965 | Behrmann . | |
| 3,711,139 | 1/1973 | Polk, Jr. . | |
| 3,851,325 | 11/1974 | Maged | 292/175 |
| 3,917,329 | 11/1975 | Fujiki et al. . | |
| 3,944,040 | 3/1976 | Richard | 70/144 |
| 4,591,684 | 5/1986 | Van Dyke . | |
| 4,601,502 | 7/1986 | Van Dyke . | |
| 4,765,663 | 8/1988 | Raymond et al. . | |
| 4,949,562 | 8/1990 | Thorncraft et al. . | |
| 4,950,005 | 8/1990 | Cudd . | |
| 5,010,749 | 4/1991 | Lin | 70/449 |
| 5,150,592 | 9/1992 | Lin | 70/190 |
| 5,186,030 | 2/1993 | Lin | 70/449 |
| 5,199,285 | 4/1993 | Lin | 70/190 |

FOREIGN PATENT DOCUMENTS

| | | | |
|---|---|---|---|
| 691325 | 5/1963 | Italy | 70/144 |

*Primary Examiner*—Flemming Saether

*Attorney, Agent, or Firm*—Waddey & Patterson; Mark J. Patterson

[57] ABSTRACT

A push lever activated dead-bolt lock for a door is described. The dead-bolt lock includes a dead-bolt axially mounted within a sleeve, the sleeve having a slot formed in each lateral side of the sleeve, the slots aligned parallel to each other and having a horizontal section and a vertical section; a cross member mounted within the dead-bolt in a position so that a first end and a second end of the cross member protrude through each slot; a spring mounted between the dead-bolt and the back wall of the sleeve; and an activator lever mounted so that one end of the activator lever contacts the first end of the cross member and the other end of the activator lever protrudes through to the exterior of the door, the activator lever oriented that movement of the lever by user moves the cross member from a position in a vertical section of the slot to a position in a horizontal section of the slot, the movement of the cross member releasing tension on the spring, the spring propelling the dead-bolt into a locked position. The lock is unlocked by returning the cross member to a vertical section of the T-shaped slot using a key. The key is inserted into a key acceptor, the key acceptor including an arm which contacts the first end of the cross member and is oriented such that when the key is turned, the arm propels cross member along horizontal section of the slot and into a vertical section of the slot, the first end of the cross member resting against the end of the activator lever opposite the end of the activator lever that protrudes to the exterior of the door. Thus, the user can activate the lock by simply pushing the activator lever.

10 Claims, 4 Drawing Sheets

LEVER ACTIVATED DEAD-BOLT LOCK

BACKGROUND OF THE INVENTION

The present invention relates generally to a dead-bolt and more particularly to a dead-bolt lock that can be activated by the push of a lever or of a button as opposed to a key.

It will be appreciated by those having ordinary skill in the art that having a dead-bolt lock is a necessary security measure for all types of residential housing. However, it is often inconvenient to take the additional step of locking the dead-bolt in that it usually requires the insertion of a key in the lock to turn the dead-bolt into place.

Several spring loaded dead-bolt locks are described in the prior art. One such lock is described in U.S. Pat. No. 4,561,684 issued to Marotto on Dec. 31, 1985. The '684 patent describes an automatic dead-bolt that is activated by the closing of the door. A spring propels the dead-bolt into opening in a retainer plate and into a strike opening in the strike plate. This process occurs automatically when the door is closed. Thus, this device does not provide the convenience of user control.

U.S. Pat. No. 4,765,663 issued to Raymond, et at. on Aug. 23, 1988. The spring loaded dead-bolt of the '663 patent is activated by turning the door knob. Specifically, the spring loaded dead-bolt is activated through a spring-loaded plunger and crank. Thus, this devices requires two springs to accomplish locking, which makes it more difficult to manufacture and presents the problem of questionable reliability.

U.S. Pat. No. 3,917,329 issued to Fujiki, et al. on Nov. 4, 1975 describes a lock that can be unlocked by a push button. The push button operates the trigger means for the lock, which retracts the latch bolt of the lock. The dead-bolt of this lock is operated by a thumb turn. The lock of this invention requires the cooperative interaction an elaborate series of parts, however, and thus presenting the problem of unreliable operation.

What is needed, then, is a dead-bolt lock that can be used to quickly, easily and reliably lock the door in which it is installed. This device is presently lacking in the prior art.

SUMMARY OF THE INVENTION

A dead-bolt lock for a door is described. The dead-bolt lock comprises a dead-bolt; activator means for activating the dead-bolt into a locked position, the activator means positioned such that the user can lock the door by pressing the activator means when the user is exterior to the door; and restraining means for restraining the dead-bolt in an unlocked position; and unlocking means for unlocking the dead-bolt, the unlocking means interacting with the restraining means and the activator means so that when the dead-bolt is moved to an unlocked position the activator means is reset for subsequent use in locking.

Preferably, the activator means comprises a spring and an activator lever, the activator lever having a first end and a second end, the second end of the activator lever protruding through to the exterior of the door, the first end of the activator lever operatively interacting with the spring so as to release the spring when the second end of the activator lever is pressed by a user, the spring mounted so as to propel the dead-bolt into a locked position.

The unlocking means can comprise a key and key acceptor, the key acceptor including an arm that is positioned such that when the key is turned the arm propels the dead-bolt into the unlocked position.

The restraining means can comprise a sleeve and a cross member, the dead-bolt axially mounted within the sleeve, the sleeve having a slot formed in each lateral side of the sleeve, the slots aligned parallel to each other, the slots having a horizontal section and a vertical section; and the cross member mounted within the dead-bolt in a position so that a first end and a second end of the cross member protrude through each slot. In this embodiment, the unlocking means can comprise a face plate mounted on the interior of the door, the face plate including a slot, the slot having horizontal and vertical sections, the second end of the cross member protruding through the slot, the cross member lying in the horizontal section of the face plate slot when the dead-bolt is locked, and the cross member resting in the vertical member of the slot when the dead-bolt is unlocked.

It is an object of this invention to provide a dead-bolt lock that can be conveniently operated by the user.

It is further an object of this invention to provide a dead-bolt lock that can be easily operated by the consumer that has a simple construction to facilitate manufacturing and to insure reliability.

Other objects of the invention will be apparent from the foregoing detailed description.

DESCRIPTION OF THE PREFERRED EMBODIMENT

Figure 1:
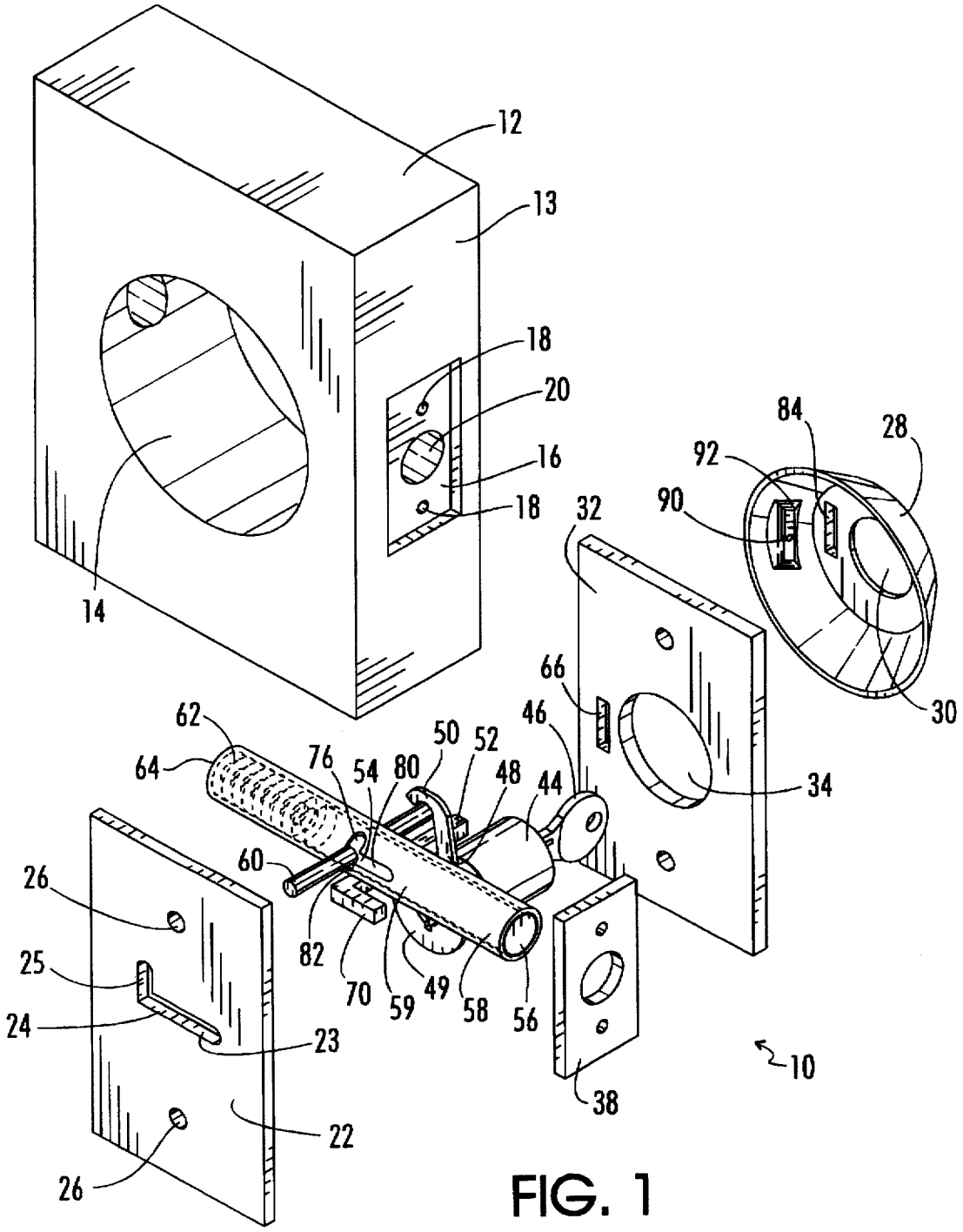
FIG. 1 is an exploded perspective view of the dead-bolt lock of this invention.

Referring now to the drawings, wherein like numerals refer to like parts throughout, a preferred embodiment of the push lever dead-bolt lock assembly of this invention is described generally at 10. Lock assembly 10 is mounted within door 12 and is mounted in the same manner as conventional dead-bolt locks. Specifically, a large bore 14 is formed from the exterior door 12 through the interior. A depression 16 is formed into the side 13 of door 12 for accepting latch plate 38. Small bores 18 are formed within depression 16. Small bores 18 accept latch plate screws or the like that are used to mount latch plate 38. A larger bore 20 is also formed within depression 16 at a point central to small bores 18. The dead-bolt 56 passes through large bore 20.

Figure 2:
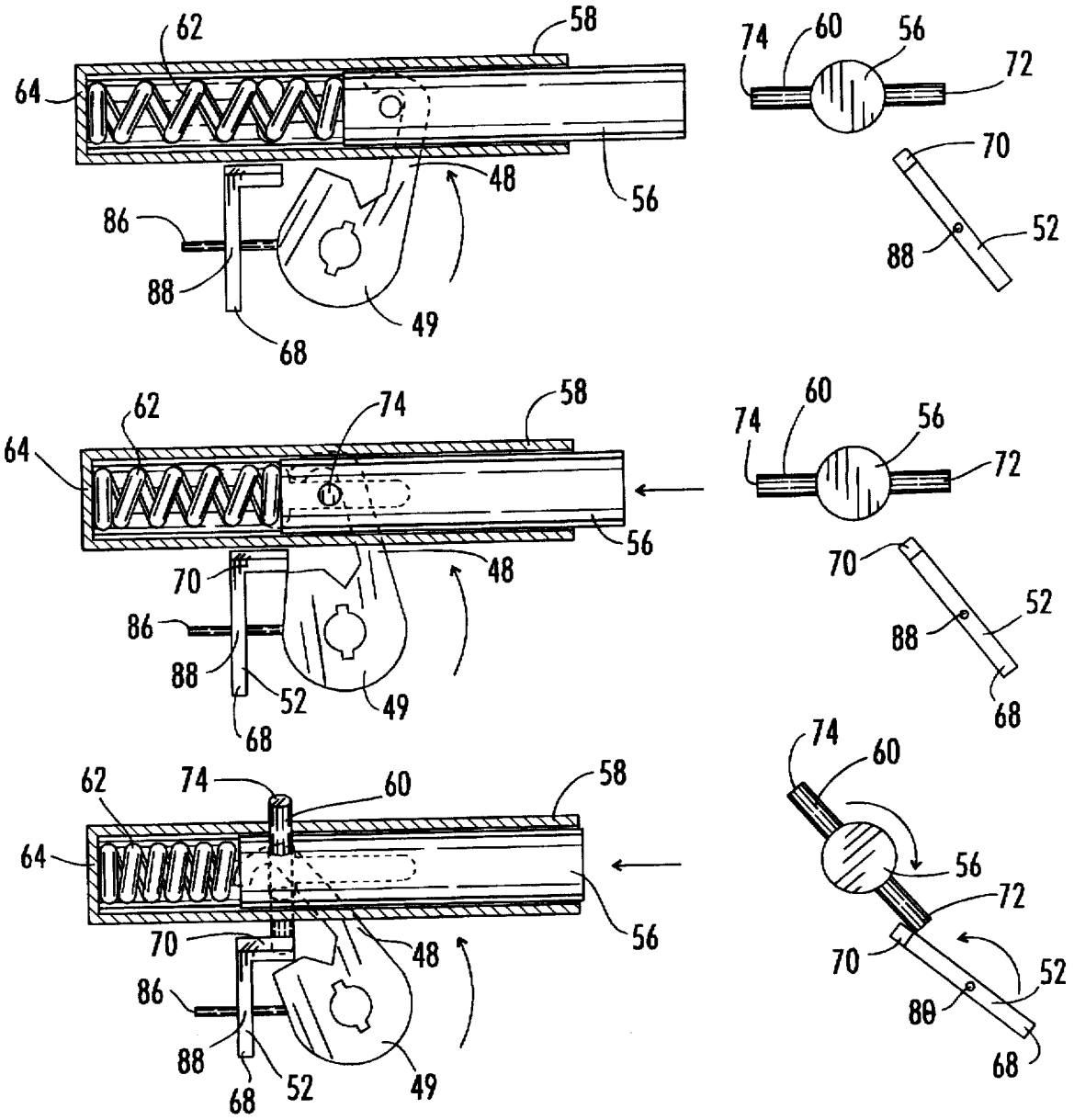
FIG. 2 is a partial sectional view of the lock of this invention and depicts the unlocking of the door.
Figure 3:
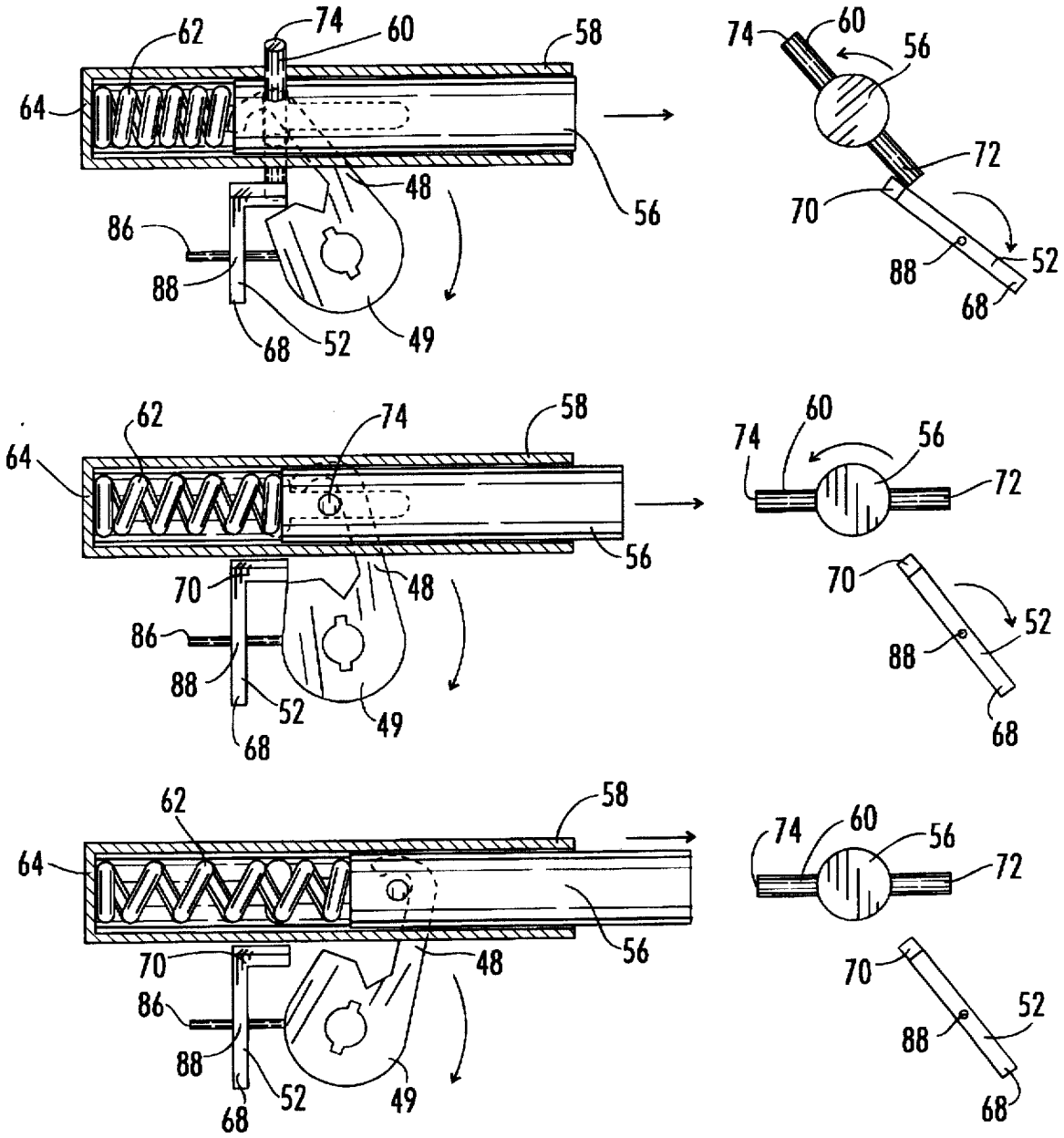
FIG. 3 is a partial sectional view of the lock of this invention and depicts the locking of the door.
Figure 4:
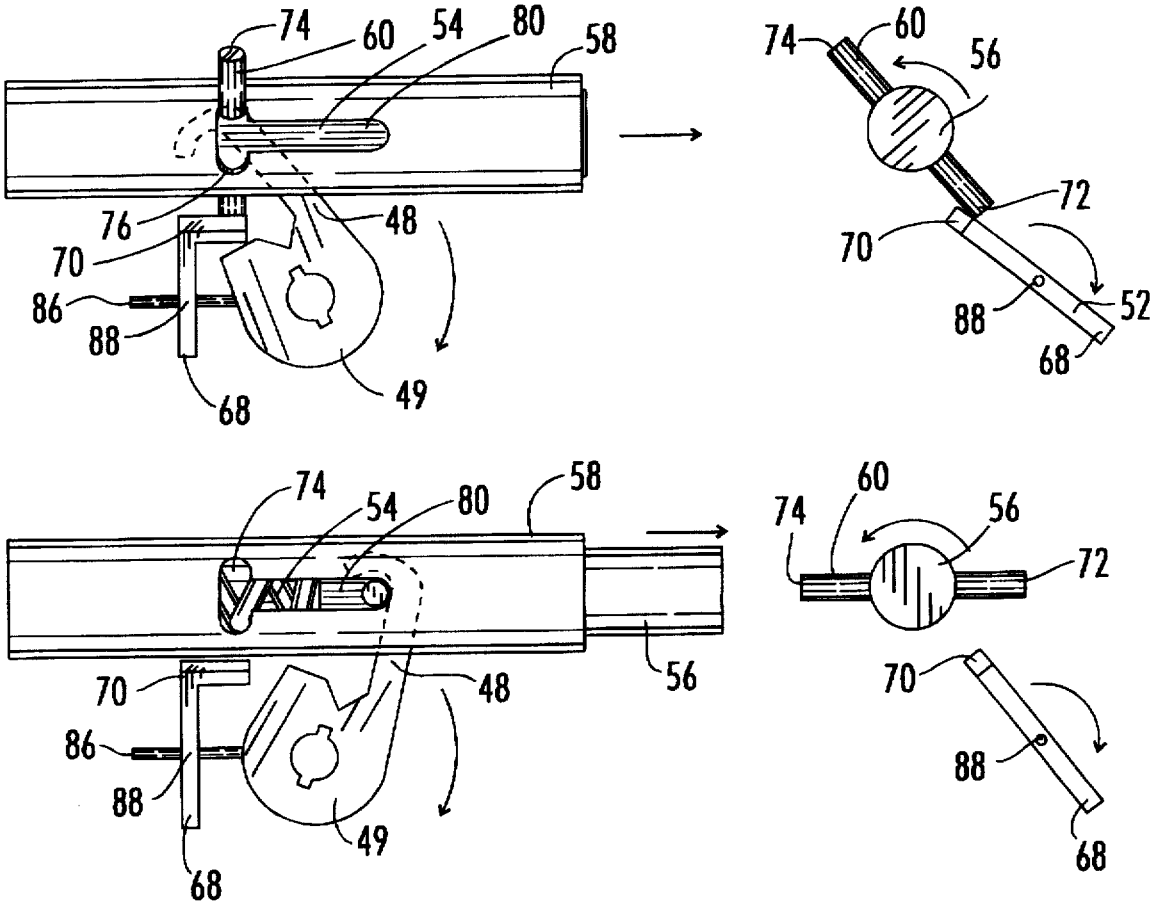
FIG. 4 is a partial side view of the lock of this invention and depicts the locking of the door.

Continuing on FIGS. 1 through 4, the details of lock assembly 10 are described. Lock 10 comprises an inner face plate 22. Inner face plate 22 is mounted to the door 12 by placing screws or the like through bores 26. Lock 10 includes a key acceptor 44 into which a key 46 is inserted. The lock also includes an outer lock cover plate 28, the outer lock cover plate 28 having a bore 30 through which key acceptor 44 passes. A key locking arm 48 extends upward from key acceptor 44 and ends in a crook 50. The base 49 of key locking arm 48 is mounted to key acceptor 44. Crook 50 rests against cross member 60 of dead-bolt 56. Dead-bolt 56 lies within sleeve 58. Cross member 60 of dead-bolt 56 protrudes from dead-bolt 56 and through the T-shaped notches 54 that are present on both lateral sides 59 of sleeve 58. As best seen in FIGS. 2 through 4, push lever 52 is mounted on support rod 86 beneath sleeve 58. Spring 62 rests within sleeve 58, and lies compressed between dead-bolt 56 and the back wall 64 of sleeve 58. Spring 62 propels dead-bolt 56 into locking position when push lever 52 is depressed, as will be more fully described below.

Lock 10 also includes outer face plate 32 which has a large bore 34 through which key 46 and key acceptor 44 pass. Outer face plate 32 is mounted between outer lock cover plate 28 and the door 12. Outer face plate 32 and outer lock cover plate 28 include slots 66 and 84, respectively, which lie adjacent to each other. Outer face plate 32 also includes base 92. Base 92 has formed therein a bore 90. Support rod 86, best seen in FIGS. 24, is mounted into bore 90 at one end and onto key acceptor 44 at the other end. First end 68 of push lever 52 protrudes through slot 66 and 84 to the exterior of the door. Thus, the user can easily access push lever 52.

Inner face plate 22 includes an L-shaped slot 24 that has a horizontal section 23 and a vertical section 25. Preferably, cross member 60 is of the length sufficient so that its end 74 will protrude through L-shaped slot 24 so that the user can lock and unlock the door from the inside using cross member 60 as will be more fully described below.

Operation of lock 10 can be best seen by referring to FIGS. 2, 3 and 4. Referring particularly to FIG. 3, the locking mechanism is described. The user of the lock 10 presses first end 68 of push lever 52 downward. Push lever 52 pivots at pivot point 88 and this action propels second end 70 of push lever 52 against first end 72 of cross member 60. This action causes the second end 74 of cross member 60 to rotate downward and out of vertical portion 76 of T-shaped slot 54 that is formed within sleeve 58. When cross member 60 is moved, cross member 60 proceeds into the horizontal section 80 of T-shaped slot 54. Spring 62, previously compressed, releases and propels dead-bolt 56 laterally until it protrudes from sleeve 58. When lock 10 is attached to a door, dead-bolt 56 will cooperatively interact with the door jam to lock the door.

Referring now to FIG. 2, the unlocking of the door is described. The door lock 10 can be unlocked by turning key 46 or by moving cross member 60 along the horizontal section 23 of L-shaped slot 24.

When a key is used, key 46 is inserted into key acceptor 44 and the user turns the key. The turn of the key 46 propels the crook 50 against cross member 60 thus propelling cross member 60 towards back wall 64 of sleeve 58. This process continues until cross member 60 reaches vertical section 76 of T-shaped slot 54. Cross member 60 is then propelled into the vertical section 76 of T-shaped slot 54, thereby locking the dead-bolt 56 into unlocked position. This causes first end 72 of cross member 60 to resume cooperative interaction with the second end 70 of push lever 52. This action also compresses spring 62. Thus, lock 10 is ready to be locked again when the user so desires.

The process of unlocking the door can also be accomplished from the inside of the house by moving cross member 60 along the horizontal section 23 of L-shaped notch 24 that is formed in plate 22 until cross member 60 reaches the vertical section 25 of L-shaped notch 24 and then the user propels cross member 60 into vertical section 25 of L-shaped notch 24. This in turn propels cross member 60 into the vertical section 76 of T-shaped slot 54 and therefore locks the dead-bolt 56 into unlocked position. This causes first end 72 of cross member 60 to resume cooperative interaction with the second end 70 of push lever 52. This action also compresses spring 62. Thus, lock 10 is ready to be locked again when the user so desires.

While the activator means of the preferred embodiment include push lever 52, it is contemplated and within the scope of this invention that a button or similar means can be mounted on outer face plate 28 over slots 84 and 66 so that the first end 68 of push lever 52 will rest in the button. Thus, the user can activate push lever 52 by pushing the button. Additionally, push lever 52 is returned to cooperative interaction with the button when dead-bolt 56 is returned to an unlocked position.

Thus, although there have been described particular embodiments of the present invention of a new and useful push button dead-bolt lock, it is not intended that such references be construed as limitations upon the scope of this invention except as set forth in the following claims. Further, although there have been described certain dimensions used in the preferred embodiment, it is not intended that such dimensions be construed as limitations upon the scope of this invention except as set forth in the following claims.

What I claim is:

1. A dead-bolt lock for a door, the dead-bolt lock comprising:

a. a dead-bolt;

b. activator means for activating the dead-bolt into a locked position, the activator means positioned such that the user can lock the door by pressing the activator means when the user is exterior to the door; and c. restraining means for restraining the dead-bolt in an unlocked position;

d. unlocking means for unlocking the dead-bolt, the unlocking means interacting with the restraining means and the activator means so that when the dead-bolt is moved to an unlocked position the activator means is reset for subsequent use in locking; and e. a sleeve receiving the entire dead-bolt in the unlocked position; the dead-bolt slidably mounted within the sleeve.

2. The dead-bolt lock according to claim 1 wherein the activator means comprises a spring and an activator lever, the activator lever having a first end and a second end, the second end of the activator lever protruding through to the exterior of the door, the first end of the activator lever operatively interacting with the spring so as to release the spring when the second end of the activator lever is pressed by a user, the spring mounted so as to propel the dead-bolt into a locked position.

3. The dead-bolt lock according to claim 1 wherein the unlocking means comprises a key and key acceptor, the key acceptor including an arm that is positioned such that when the key is turned the arm propels the dead-bolt into the unlocked position.

4. The dead-bolt locked according to claim 1 wherein the restraining means comprise the sleeve and a cross member, the dead-bolt axially mounted within the sleeve, the sleeve having a slot formed in each lateral side of the sleeve, the slots aligned parallel to each other, the slots having a horizontal section and a vertical section; and the cross member mounted within the dead-bolt in a position so that a first end and a second end of the cross member protrude through each slot.

5. The dead-bolt lock according to claim 4 wherein the unlocking means comprises a face plate mountable on the interior of the door, the face plate including a slot, the slot having horizontal and vertical sections, the second end of the cross member protruding through the slot, the cross member lying in the horizontal section of the face plate slot when the dead-bolt is locked, and the cross member resting in the vertical member of the slot when the dead-bolt is unlocked.

6. The dead-bolt locked according to claim 1 wherein the sleeve includes the restraining means.

7. A dead-bolt lock for a door, the dead-bolt lock comprising:

a. a dead-bolt axially mounted within a sleeve, the sleeve having a slot formed in each lateral side of the sleeve, the slots aligned parallel to each other, the shaped slots having a horizontal section and a vertical section;

b. a cross member mounted within the dead-bolt in a position so that a first end and a second end of the cross member protrude through each slot;

c. a spring mounted between the dead-bolt and a back wall of the sleeve;

d. an activator mounted so that one end of the activator lever contacts the first end of the cross member and the other end of the activator lever protrudes through to the exterior of the door, the activator oriented so that movement of the activator by the user moves the cross member from a position in a vertical section of the slot to a position in a horizontal section of the slot, the movement of the cross member releasing tension on the spring, the spring propelling the dead-bolt into a locked position; and e. unlocking means for unlocking the door by returning the cross member to a vertical section of the slot.

8. The dead-bolt lock according to claim 7 wherein the second end of the cross member protrudes through to the interior of the door.

9. The dead-bolt lock according to claim 8 further comprising a face plate mountable on the interior of the door, the face plate including a slot, the slot having horizontal and vertical sections, the second end of the cross member protruding through the slot, the cross member lying in the horizontal section of the slot when the dead-bolt is locked, and the cross member resting in the vertical member of the slot when the dead-bolt is unlocked.

10. The dead-bolt lock according to claim 7 wherein the unlocking means further comprises a key and key acceptor, the key acceptor including an arm which contacts the first end of the cross member and is oriented such that when the key is turned the arm propels cross member along the horizontal section of the slot and into a vertical section of the slot, the first end of the cross member resting against the end of the activator opposite the end of the activator that protrudes to the exterior of the door.

* * * * *